United States Patent [19]

Myler et al.

[11] Patent Number: 5,062,255

[45] Date of Patent: Nov. 5, 1991

[54] BRIDLE BIT

[76] Inventors: Ronald J. Myler, P.O. Box 143, Crockett, Tex. 75835; Leo Benjak, 24 Barakee St., Marsden 4203 Queensland, Australia

[21] Appl. No.: 407,624

[22] Filed: Sep. 15, 1989

Related U.S. Application Data

[63] Continuation-in-part of Ser. No. 196,073, May 19, 1988, Pat. No. 4,884,390.

[51] Int. Cl.[5] ..... B68B 1/06

[52] U.S. Cl. ..... 54/7

[58] Field of Search ..... 54/7, 8, 9

[56] References Cited

U.S. PATENT DOCUMENTS

| | | | |
|---|---|---|---|
| 478,867 | 7/1892 | James | 54/7 |
| 3,628,308 | 12/1971 | Lozier | 54/8 |
| 4,884,390 | 12/1989 | Benjak et al. | 54/7 |

FOREIGN PATENT DOCUMENTS

| | | | |
|---|---|---|---|
| 18482 | 5/1905 | United Kingdom | 54/7 |

*Primary Examiner*—Robert P. Swiatek

*Attorney, Agent, or Firm*—Neal J. Mosely

[57] ABSTRACT

A bridle bit for horses comprises a mouthpiece to be received in the mouth of a horse. A head stall ring member rotatably mounted through the outward ends of the mouthpiece member has a portion extending through the mouthpiece outward ends secured to a cylindrical cheek piece member which rotates therewith. The cheek piece members extend forwardly from the outward ends of the mouthpiece member and reside closely adjacent the cheek of the horse and a rein ring member is rotatably mounted on each cheek piece member extending forwardly therefrom and the forward end is adapted to receive rein apparatus. The head stall ring member may also have a slot adapted to receive a curb chain. The mouthpiece members move independently of one another, the head stall and cheek piece members rotate about their longitudinal axis as a unit relative to the mouthpiece members, and the rein ring members and cheek piece members rotate about their longitudinal axis as a unit relative to the mouthpiece members and the head stall members rotate partially about their longitudinal axis relative to the cheek piece members. The fully rotatable shank may be used with any suitable mouthpiece, including mouthpieces of a fixed construction and two and three part snaffle mouthpieces.

20 Claims, 1 Drawing Sheet

BRIDLE BITcl CROSS REFERENCE TO RELATED APPLICATION

This application is a continuation-in-part of copending application Ser. No. 196,073, filed 05/19/88, now U.S. Pat. No. 4,884,390.

BACKGROUND OF THE INVENTION

1. FIELD OF THE INVENTION

This invention relates generally to bridle bits, and more particularly to a bridle bit having a mouthpiece with independently movable cheek pieces at each end and rotatable head stall and rein ring connections fore and aft of the cheek pieces.

2. BRIEF DESCRIPTION OF THE PRIOR ART

Jointed bridle bits and bridoons are known in the art. There are several patents which disclose loose jointed bridle bits and bridoons of various constructions.

Squier, U.S. Pat. No. 472,145 discloses a bridle bit having the mouthpiece formed of an intermediate core consisting of one or more links with the cheek pieces looped through the end links.

Meyer, U.S. Pat. No. 1,796,608 discloses a bridle bit having a two-part mouthpiece formed of two loosely connected members, each having an enlarged portion at a point adjacent the point of connection which extends rearwardly of the bit to prevent squeezing the horses cheeks against its teeth.

Sprenger, U.S. Pat. No. 3,745,743 discloses a method of making a bridoon whereby at least two pipe pieces are tapered and flatened on one end and have rings welded thereon which are joined together to form a loosely connected mouthpiece and the opposite ends have jackets welded thereon which have enlarged rings to receive and mount the bridle.

Simington, U.S. Pat. No. 4,005,564 discloses a bridle bit having an elongated mouthpiece pivotally attached at opposite ends to bridle rings. The mouthpiece is constructed from a pair of substantially rigid arms, each joined to a center coupling by a ball and socket joint. The center coupling includes a cylindrical roller which cooperates with the ball and socket joints and permits the bit to function as a pacifier.

Benjak et al. U.S. patent application Ser. No. 196,073 discloses a bridle bit wherein the mouthpiece members move independently of one another, the head stall and cheek piece members rotate about their longitudinal axis as a unit relative to the mouthpiece members, and the rein ring members and cheek piece members rotate about their longitudinal axis as a unit relative to the mouthpiece members and the head stall members rotate completely, i.e. 360°, about their longitudinal axis relative to the cheek piece members.

The present invention is distinguished over the prior art in general, and these patents in particular by a bridle bit comprising a mouthpiece to be received in the mouth of a horse. A head stall ring member is rotatably mounted through the outward ends of the mouthpiece member has a portion extending through the mouthpiece outward ends secured to a cylindrical cheek piece member which rotates therewith. The cheek piece members extend forwardly from the outward ends of the mouthpiece member and reside closely adjacent the cheek of the horse and a rein ring member is rotatably mounted on each cheek piece member extending forwardly therefrom and the forward end is adapted to receive rein apparatus. The head stall ring member may also have a slot adapted to receive a curb chain. The mouthpiece members move independently of one another, the head stall and cheek piece members rotate about their longitudinal axis as a unit relative to the mouthpiece members, and the rein ring members and cheek piece members rotate about their longitudinal axis as a unit relative to the mouthpiece members and the head stall members rotate partially about their longitudinal axis relative to the cheek piece members. The fully rotatable shank may be used with any suitable mouthpiece, including mouthpieces of a fixed construction and two and three part snaffle mouthpieces.

SUMMARY OF THE INVENTION

It is therefore an object of the present invention to provide a bridle bit having a mouthpiece having shank members which allow universal movement about the ends of the mouthpiece member.

It is another object of this invention to provide a bridle bit having a cheek piece at each outer end of a mouthpiece which allows independent movement of the cheek pieces relative to on another.

Another object of this invention is to provide a bridle bit having a cheek piece at each outer end of a mouthpiece and a head stall ring rotatably mounted rearwardly of the outer ends of the mouthpiece member for rotational movement relative thereto.

Another object of this invention is to provide a bridle bit having a cheek piece at each outer end of a mouthpiece with a head stall ring rotatably mounted rearwardly of the outer ends of the mouthpiece member and rein ring rotatably mounted forwardly of the outer ends of the mouthpiece member whereby the head stall ring and rein ring members rotate relative to one another.

A further object of this invention is to provide a bridle bit having a cheek piece at each outer end of a mouthpiece with a head stall ring rotatably mounted rearwardly of the outer ends of the mouthpiece member and a rein ring rotatably mounted forwardly of the outer ends of the mouthpiece member which allows independent movement of the cheek pieces relative to one another and the head stall ring and rein ring members to rotate relative to one another.

A still further object of this invention is to provide a bridle bit which is attractive, simple in construction, economical to manufacture, and rugged and durable in use.

Other objects of the invention will become apparent from time to time throughout the specification and claims as hereinafter related.

The above noted objects and other objects of the invention are accomplished by a bridle bit for horses which comprises a mouthpiece to be received in the mouth of a horse. A head stall ring member is rotatably mounted through the outward ends of the mouthpiece member has a portion extending through the mouthpiece outward ends secured to a cylindrical cheek piece member which rotates therewith. The cheek piece members extend forwardly from the outward ends of the mouthpiece member and reside closely adjacent the cheek of the horse and a rein ring member is rotatably mounted on each cheek piece member extending forwardly therefrom and the forward end is adapted to receive rein apparatus. The head stall ring member may also have a slot adapted to receive a curb chain. The mouthpiece members move independently of one another, the head stall and cheek piece members rotate about their longitudinal axis as a unit relative to the mouthpiece members, and the rein ring members and cheek piece members rotate about their longitudinal axis as a unit relative to the mouthpiece members and the head stall members rotate partially about their longitudinal axis relative to the cheek piece members. The fully rotatable shank may be used with any suitable mouthpiece, including mouthpieces of a fixed construction and two and three part snaffle mouthpieces.

BRIEF DESCRIPTION OF THE DRAWINGS

FIG. 1 is an isometric view of the bridle bit in accordance with the present invention.

DESCRIPTION OF THE PREFERRED EMBODIMENT

Figure 3:
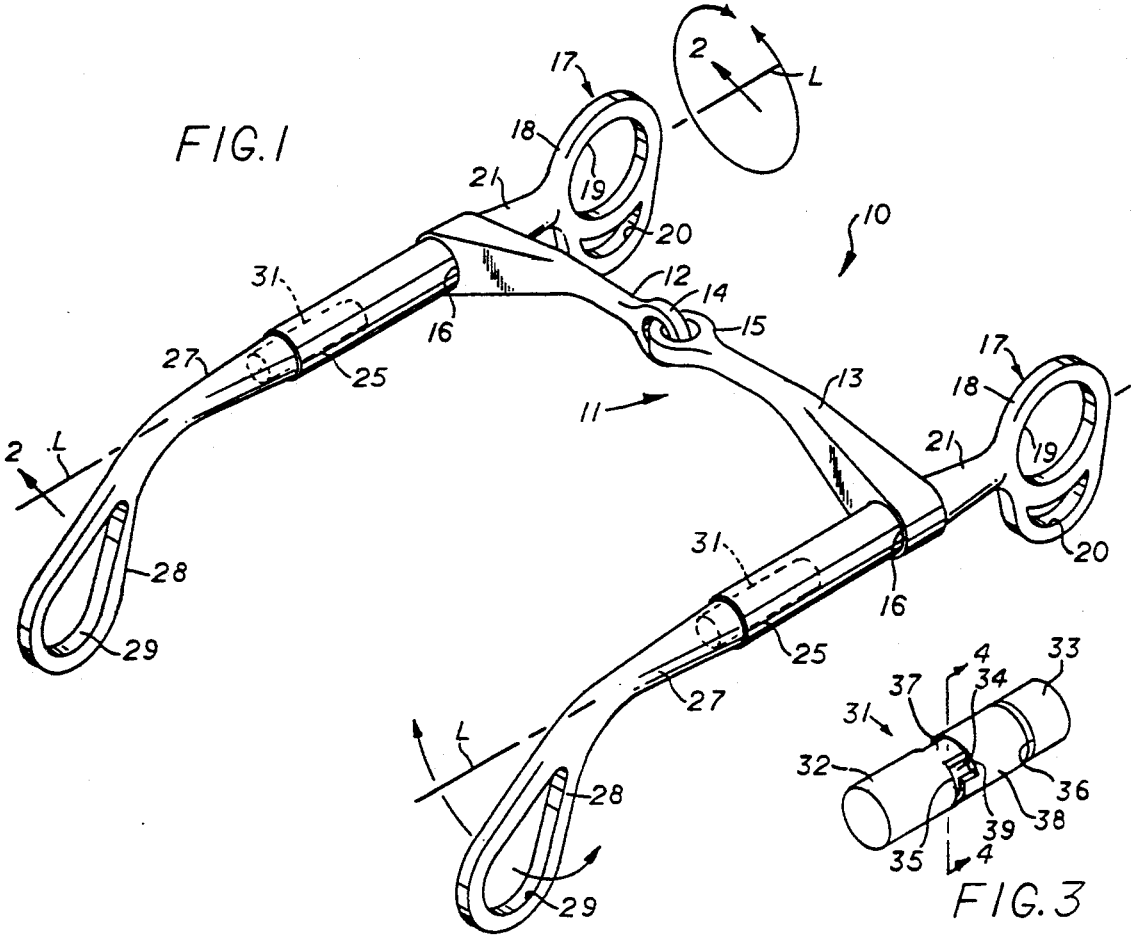
FIG. 3 is an isometric view of a bearing member of the present invention.
Figure 5:
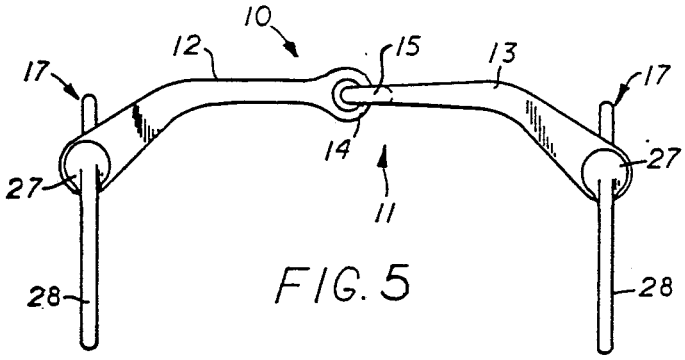
FIG. 5 is a front elevation of the bridle bit.

Referring to the drawings by numerals of reference, there is shown in FIG. 1, a preferred bridle bit 10. The bridle bit has a fully rotatable shank which may be used with any suitable mouthpiece, including mouthpieces of a fixed construction and two and three part snaffle mouthpieces. The preferred embodiment is described as applied to a two-piece snaffle mouthpiece but other mouthpieces may be used. The bridle bit 10 comprises a two-part snaffle mouthpiece formed by two members 12 and 13 having eyes or loops 14 and 15 respectively. The loops 14 and 15 are formed on the respective inner ends of the members 12 and 13 and are interconnected in a perpendicular relation to one another to allow independent relative movement.

Each of the members 12 and 13 is slightly curved longitudinally and the free ends of the members terminate in a rounded configuration each having a hole 16 transverse to the longitudinal axis of the member.

A head stall ring member 17 is disposed at one end of each mouthpiece member 14 and 15. Each head stall ring member 17 comprises a generally elliptical end 18 having a hole 19 for the attachment of a head strap and a lower generally crescent-shaped aperture 20 therebelow to define a curb chain slot for the attachment of a curb chain.

The head stall ring 17 has a cylindrical portion 21 extending from the circular end 18 and a reduced diameter shaft 22 extending therefrom with a shoulder 23 therebetween. The shaft 22 is slidably and rotatably received through the hole 16 in the members 12 and 13 in bearing relation therewith.

The end of the shaft 22 extending beyond the hole 16 is press fitted into a bore 24 in one end of a cylindrical bit shank or cheek piece 25. The other end of each cheek piece 25 has an internal bore 26 which rotatably connects an elongate rein ring member 27 extending forwardly of the cheek piece 25.

Each rein ring member 27 comprises a cylindrical portion slightly curved longitudinally which terminates in a rounded looped configuration 28 having an elliptical aperture 29 transverse to the longitudinal axis L of the member 27 for the attachment of the reins. A bore 30 extends inwardly at the cylindrical end of the rein ring member 27.

Figure 4:
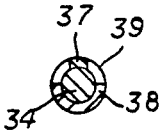
FIG. 4 is a transverse cross section of the bearing member taken along line 4—4 of FIG. 3.
Figure 2:
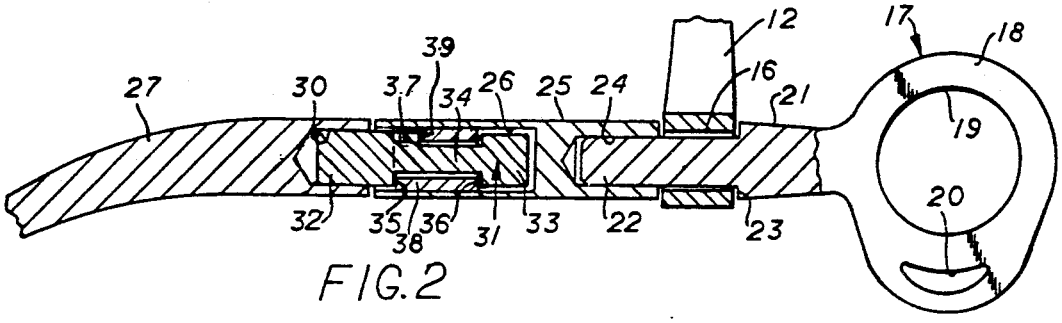
FIG. 2 is a longitudinal cross section of one side of the bridle bit taken along lines 2—2 of FIG. 1.

A pair of cylindrical bearing members 31 each have enlarged diameter portions 32 and 33 at each end and a reduced diameter shaft portion 34 extending therebetween defining opposed shoulders 35 and 36. The circumference of shoulder 35 is cut away to leave a narrow projection 37 extending along the shaft portion 34 a short distance toward shoulder 36. A tubular bearing sleeve 38 is slidably and rotatably carried on the shaft portion 34 between the shoulders 35 and 36. The side wall of the bearing sleeve 38 is cut away at one end to define a radial slot 39 extending approximately 180° around the circumference. The narrow projection 37 is received in the slot 39 whereby the sleeve 38 will rotate relative to the enlarged diameter portions 32 and 33 and vice versa (FIG. 4).

The enlarged diameter 32 at one end of each bearing member 31 is press fitted into the bore 30 of the rein ring member 27 to retain the bearing thereon. The enlarged diameter 33 at the other end of each bearing member 3! is smaller than the bore 26 in the cheek piece 25 to be slidably and rotatably received therein. The outside diameter of bearing sleeve 38 is sufficient to provide an interference fit in the bore 26. The assembled bearing member 31, bearing sleeve 38, and rein ring members 27 are press fitted into the bore 26 in the end of the cheek piece 25.

The construction of two-piece snaffle mouthpiece 11 of the bridle bit 10 allows independent movement of the cheek pieces 25 relative to one another. The head stall ring 17 is fixed to the cheek piece 25 through the hole 16 in the outer end of the mouthpiece members 12 and 13 and both the cheek piece 25 and head stall ring 17 are free to rotate as a unit about their longitudinal axis L relative to the mouthpiece members. The rein ring members 27 are journalled at the end of the cheek pieces 25 and are free to rotate as a unit about longitudinal axis L relative to mouthpiece members 12 and 13 and rein ring members 27 are free to rotate approximately 60° relative to the cheek piece 25.

The bridle bit 10 of the present invention provides an improved mouthpiece with a head stall ring rotatably mounted rearwardly of the outer ends of the mouthpiece member and a rein ring rotatably mounted forwardly of the outer ends of the mouthpiece member which allows independent movement of the cheek pieces relative to one another and the head stall ring and rein ring members to rotate relative to one another.

While this invention has been described fully and completely with special emphasis upon a preferred embodiment, it should be understood that within the scope of the appended claims the invention may be practiced otherwise than as specifically described herein.

We claim:

1. A bridle bit comprising a mouthpiece member adapted to be received in the mouth of a horse and having laterally extending ends, head stall ring members mounted on the outer ends of said mouthpiece and extending rearwardly therefrom, a curb chain slot in said head stall ring member, a cheek piece member extending forwardly from each lateral end of said mouthpiece to reside closely adjacent the cheek of the horse, a rein ring member rotatably mounted on each said cheek piece member and extending forwardly therefrom and rotatable relative thereto partially about their longitudinal axes, and means supporting said head stall ring member and cheek piece member for rotation as a unit relative to each other and relative to said mouthpiece member.

2. A bridle bit according to claim 1 in which
said cheek piece members are mounted for rotation about their longitudinal axes near the outer ends of said mouthpiece member.

3. A bridle bit according to claim 1 in which
said head stall members are mounted for rotation about their longitudinal axes on the outer ends of said mouthpiece member.

4. A bridle bit according to claim 1 in which
said rein ring members are mounted for partial rotation about their longitudinal axes mounted for partial rotation about their longitudinal axes forwardly of the lateral ends of said cheek piece member.

5. A bridle bit according to claim 1 in which
said cheek piece members are mounted for rotation about their longitudinal axes on the outer ends of said mouthpiece member,
said rein ring members are mounted for partial rotation about their longitudinal axes forwardly of the lateral ends of said mouthpiece member, and
said head stall members and said rein ring members rotate relative to the outer ends of said mouthpiece member and to one another about their longitudinal axis.

6. A bridle bit according to claim 1 in which
said cheek piece members are mounted for rotation about their longitudinal axes near the outer ends of said mouthpiece member,
said head stall members are mounted for rotation about their longitudinal axes on the outer ends of said mouthpiece member and secured on the rearward end of said cheek members,
said head stall members and said cheek piece members rotate as a unit relative to the outer ends of said mouthpiece member about the respective longitudinal axes of said head stall and said cheek piece members, and
said rein ring members are rotatably mounted on the forward ends of said cheek piece members and rotate therewith as a unit relative to the outward ends of said mouthpiece members and partially rotate relative to said cheek piece members about the longitudinal axes of said rein ring members.

7. A bridle bit according to claim 6 in which
a head stall hole is located in said head stall ring member above said curb chain slot.

8. A bridle bit according to claim 6 in which
said rein ring members are rotatably mounted on the forward end of said cheek piece members and partially rotate relative thereto, whereby
said head stall members and said cheek members rotate as a unit about their longitudinal axis relative to the outer ends of said mouthpiece member, and
said rein ring members and said cheek piece members rotate as a unit about their longitudinal axis relative to the outward ends of said mouthpiece members and said head stall members.

9. A bridle bit according to claim 1 in which
said mouthpiece member is a snaffle mouthpiece having a plurality of parts adapted to be received in the mouth of a horse and having laterally extending ends, and
said head stall ring members are mounted on the outer ends of said mouthpiece parts.

10. A bridle bit according to claim 9 in which
said snaffle mouthpiece member comprises a multiple-piece assembly formed of two or more loosely connected members joined together at one end for independent relative movement of the members and their other ends extend laterally outward from the connection.

11. A bridle bit according to claim 9 in which
said snaffle mouthpiece member comprises a multiple-piece assembly formed of two or more loosely connected members joined together at one end for independent relative movement of the members and their other ends extend laterally outward from the connection, and
said head stall ring members and cheek piece members are supported for rotation as a unit relative to each other near the respective outer ends of said snaffle mouthpiece member.

12. A bridle bit according to claim 9 in which
said cheek piece members are mounted for rotation about their longitudinal axes on the outer ends of said snaffle mouthpiece member.

13. A bridle bit according to claim 9 in which
said head stall members are mounted for rotation about their longitudinal axes on the outer ends of said snaffle mouthpiece member.

14. A bridle bit according to claim 9 in which
said rein ring members are mounted for partial rotation about their longitudinal axes forwardly of the lateral ends of said snaffle mouthpiece member.

15. A bridle bit according to claim 9 in which
said cheek piece members are mounted for rotation about their longitudinal axes on the outer ends of said snaffle mouthpiece member,
said head stall members are mounted for rotation about their longitudinal axes on the outer ends of said snaffle mouthpiece member,
said rein ring members are mounted for partial rotation about their longitudinal axes forwardly of the lateral ends of said snaffle mouthpiece member, and
said head stall members and said rein ring members rotate relative to the outer ends of said snaffle mouthpiece member and to one another about their longitudinal axis.

16. A bridle bit according to claim 9 in which
said snaffle mouthpiece member comprises a two-piece assembly formed of two members each having an eye at one end loosely interconnected together for independent relative movement of the members and their other ends extend outward from the connection and are slightly curved longitudinally and the outer free ends of each member terminate in a rounded configuration having a hole therethrough transverse to the longitudinal axis of the member,
each said head stall member having a generally eliptical circular end with a hole therethrough and a cylindrical portion extending from the circular end having a reduced diameter portion extending from the cylindrical portion slidably and rotatably received through the hole in the outer ends of said mouthpiece members,
each said cheek piece member comprising an elongate cylindrical member disposed forwardly of the outward ends of said mouthpiece members to reside closely adjacent the cheek of the horse,
said head stall reduced diameter portion extending through said hole and secured to the rearward end said cheek piece, and said rein ring members each rotatably mounted on the forward end of said cheek piece members and partially rotate relative thereto, whereby said head stall members and said cheek members rotate as a unit about their longitudinal axis relative to the outer ends of said snaffle mouthpiece member, and said rein ring members and said cheek piece members rotate as a unit about their longitudinal axis relative to the outward ends of said snaffle mouthpiece members and said head stall members.

17. A bridle bit comprising a mouthpiece member adapted to be received in the mouth of a horse and having laterally extending ends, head stall ring members mounted on the outer ends of said mouthpiece and extending rearwardly therefrom, a curb chain slot in said head stall ring member, a cheek piece member extending forwardly from each lateral end of said mouthpiece to reside closely adjacent the cheek of the horse, said head stall members are mounted for rotation about their longitudinal axes on the outer ends of said mouthpiece member and secured on the rearward end of said cheek members, said cheek piece members are mounted for rotation about their longitudinal axes near the outer ends of said mouthpiece member, said head stall members and said cheek piece members rotate as a unit relative to the outer ends of said mouthpiece member about the respective longitudinal axes of said head stall and said cheek piece members, and a rein ring member rotatably mounted on each said cheek piece member and extending forwardly therefrom and rotatable relative thereto partially about their longitudinal axes, and said rein ring members are rotatably mounted on the forward ends of said cheek piece members and rotate therewith as a unit relative to the outward ends of said mouthpiece members and partially rotate relative to said cheek members.

means supporting said head stall ring member and cheek piece member for rotation as a unit relative to said rein ring member and relative to said mouthpiece member, said rein ring members each comprise an elongate cylindrical portion slightly curved longitudinal terminating at one end in a rounded loop configured for the attachment of rein apparatus, and a bearing member fixed on the opposite end of the cylindrical portion, said bearing member journalled within the forward end of said cheek piece member.

18. A bridle bit according to claim 17 in which each said bearing member comprises a cylindrical member having enlarged diameter portions at each end and a reduced diameter shaft portion extending therebetween defining opposed circumferential shoulders, a tubular bearing sleeve slidably and rotatably carried on said shaft portion between said opposed shoulders, and stop means extending between said sleeve and one of said shoulders for limiting the relative rotational between said sleeve and said enlarged diameter ends, one said enlarged diameter portion being fixed within the bore of said rein ring member to retain the bearing thereon and the opposed enlarged diameter portion being slidably and rotatably received within the bore of said cheek piece member and the outside diameter of said sleeve fixed within same said bore, whereby said rein ring members rotate as a unit with said cheek piece members relative to the outward ends of said mouthpiece member and partially rotate relative to said cheek piece members about the longitudinal axis of said rein ring members.

19. A bridle bit according to claim 18 in which said stop means comprises a projection on the reduced diameter shaft portion of said bearing member and a circumferential slot in said tubular bearing sleeve, and said projection is received in said slot whereby said sleeve will rotate a through a predetermined angle relative to said enlarged diameter portions and vice versa.

20. A bridle bit according to claim 19 in which said projection and slot are configured to allow said ring rein members to rotate as a unit with said cheek piece members relative to the outward ends of said mouthpiece member and partially rotate through an angle of 30° relative to said cheek piece members about the longitudinal axis of said rein ring members.

* * * * *